United States Patent [19]

Somkaite et al.

[11] 4,116,824

[45] Sep. 26, 1978

[54] AUTOMATED WET SIEVING APPARATUS

[75] Inventors: Rozalija Somkaite, South Orange; Bela Toth, New Providence, both of N.J.

[73] Assignee: Armour Pharmaceutical Company, Phoenix, Ariz.

[21] Appl. No.: 741,327

[22] Filed: Nov. 12, 1976

[51] Int. Cl.[2] ..... B07B 1/46

[52] U.S. Cl. ..... 209/262; 209/237; 209/254; 209/332

[58] Field of Search ..... 209/262, 254, 237, 268, 209/498, 500, 240, 243, 245, 242, 250, 17, 269, 332; 210/416 R, 456; 222/189; 259/4

[56] References Cited

U.S. PATENT DOCUMENTS

| | | | |
|---|---|---|---|
| 339,723 | 4/1886 | Winkler | 209/262 |
| 383,284 | 5/1888 | Droughton | 209/500 X |
| 890,527 | 6/1908 | Nutter | 209/262 |
| 1,794,824 | 3/1931 | Bendelari | 209/500 |
| 2,066,364 | 1/1937 | Rafton | 209/332 X |
| 2,211,068 | 8/1940 | McDonald | 209/500 X |
| 2,990,238 | 6/1961 | Kabisch | 210/416 R X |
| 3,217,561 | 11/1965 | Allgaier | 209/332 X |
| 3,476,245 | 11/1969 | Swallow | 209/332 X |

FOREIGN PATENT DOCUMENTS

| | | | |
|---|---|---|---|
| 1,944,623 | 3/1971 | Fed. Rep. of Germany | 209/250 |
| 2,353,077 | 5/1974 | Fed. Rep. of Germany | 209/250 |

*Primary Examiner*—Robert Halper

*Attorney, Agent, or Firm*—Richard R. Mybeck; William W. Schwarze

[57] ABSTRACT

An automated wet sieving apparatus and process are provided comprising a wetting liquid distributor which is coupled by eccentric disks to a motor which drives the distributor in an orbital path for supplying the liquid onto a sieve. Means are provided for creating alternating vacuum and pressure below the sieve. The vacuum draws undersized particles whose size is being determined through the sieve and the pressure loosens blinding particles from the sieve. Preferably, the sieve is cyclically tilted as the wetting liquid is being distributed onto the sieve.

9 Claims, 2 Drawing Figures

FIG. 1
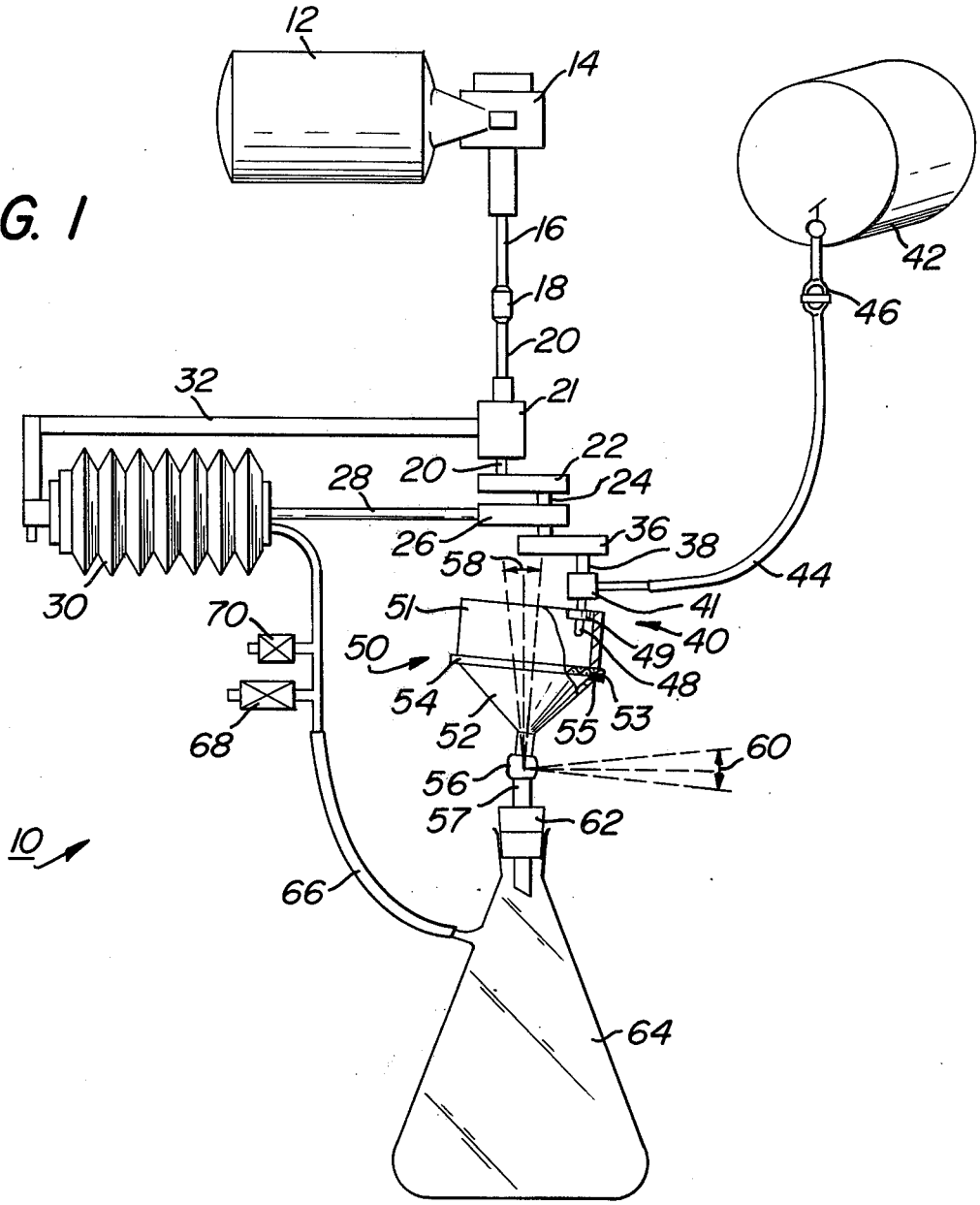
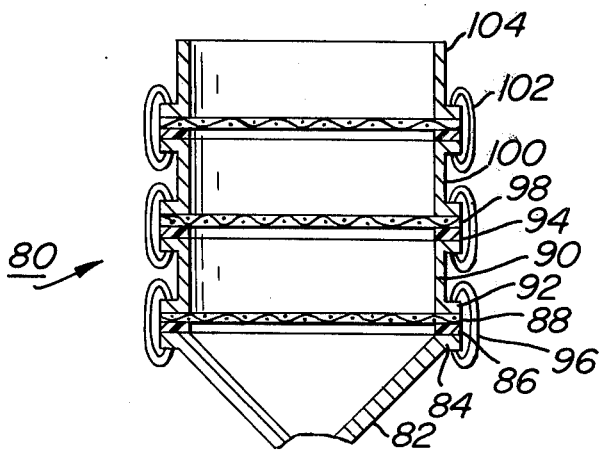
FIG. 2

AUTOMATED WET SIEVING APPARATUS

BACKGROUND OF THE INVENTION

In recent years, major advances have been made in small particle technology. Many industries are particularly concerned with the characteristics and effects of small particles.

In the paint industry, particle size may determine the opacity of pigments, and the durability, consistency, dispersibility, etc. of paint. In the cement industry, particle size is important in determining permeability, rate of hydration, strength, etc. of concrete. In the ceramics field, particle size is important in adjusting the porosity, strength, plasticity, effect on sintering, etc. of the ceramic products. Other industries where particle size is important, if not critical, include power metallurgy, pulp and paper, soaps and synthetic detergents, catalysts, air pollution control, aerosol technology, and health, among others. In these industries, products are produced in which product size is critical for the intended performance of the particular product.

In view of the wide spread use of small particles in many different technologies, it is important to be able to accurately determine particle size. Some of the better known methods for determining particle size based on physical properties of the particles are sedimentation, permeability, light scattering, adsorption, diffusion and sieving.

The present invention relates to an automated wet sieving apparatus and process for analysis of particles below about 100$\mu$ in diameter. Of particular interest are particles below about 44$\mu$ in diameter.

Two published articles co-authored by applicants represent the closest prior art known to applicants. In R. D. Desai, B. Toth and R. Somkaite, "Particle Size Analysis Of Chlorhydrol By Wet Sieving," *Drug & Cosmetic Industry,* December 1972, p. 50, one type of wet sieving apparatus and process is disclosed. Chlorhydrol, a registered trademark of Reheis Chemical Company for aluminum chlorhydrate, is a prime active ingredient in aerosol antiperspirants. Because of the use of relatively high concentrations of this highly deliquescent aluminum salt, aerosol valves through which this product is dispensed tend to clog. An Analyt-3 dry and aqueous wet sieving apparatus was extensively modified to permit non-aqueous wet sieving. A sample of Chlorhydrol was placed on a selected sieve and was subjected to vertical oscillations produced by an electromagnet. A varistaltic pump controlled the flow of wetting liquid through a spray nozzle which wetted the particles until the liquid issuing from the sieve was clear. The residue remaining on the sieve was then weighed.

The Analyt-3 instrument was unsuccessfully modified so as to use 3 inch standard sieves (44 $\mu$ and smaller) instead of the 8 inch standard sieves. Two major factors were regulated during the sieving process: (1) the vertical oscillations of the vibrator and (2) the flow rate of the wetting liquid. Even at the lowest vibrating amplitude, the Chlorhydrol particles did not pass through the sieve, primarily because of the low density of the sample particles. Consequently, the hindered particles allowed the wetting liquid to flow uniformly through the sieve, which resulted in the accumulation of liquid to the point of overflow.

In their second publication, R. Somkaite, R. D. Desai, and B. Toth, "Particle Size Analysis Of Chlorhydrol," *Drug & Cosmetic Industry,* November 1974, p. 54, the Analyt-3 was successfully modified to accommodate the 3 inch standard sieves. The bottom pan of the Analyt-3 instrument was modified so that the vibration was uniformly distributed to permit satisfactory sievability when a 3 inch sieve rests on it. The same procedure was then followed as for eight inch standard sieving. The precision of the method using the modified Analyt-3 instrument for wet microsieving of Chlorhydrol, using 10 $\mu$, 15 $\mu$ and 44 $\mu$, 3 inch standard size sieves was reported as considerably improved over their first publication. The sieves used in the modified apparatus still showed a tendency to become blinded. Additionally, the wetting liquid is directed at the same portions of the sieve when using a particular spray nozzle, rather than being distributed over substantially the entire surface of the sieve, as would be possible by swirling the wetting liquid as it passes over the sieve.

Two U.S. patents issued to Pitchford, U.S. Pat. Nos. 3,167,259 and 3,167,503, deal with the problem of blinding of screens used in particle separation. Particles to be separated are introduced into a particle receiving chamber having screens arranged at opposite ends of the chamber. Air is pulsed alternately through the chamber so that the screen at the inlet end is cleaned and the particles within the chamber are blasted against the screen at the outlet end of the chamber. In the alternate pulse, the direction of air is reversed so that the original outlet end becomes the inlet end for the air. Thus, the screen at the former outlet end is cleaned and the particles within the chamber are blasted against the screen at the former inlet end. This process is repeated until the desired degree of separation is attained. The air pulsed alternately into the chamber may be produced by positive pressure on the inlet side or by a negative pressure on the outlet side. There is no disclosure of alternating positive pressure with negative pressure as is done in the process and apparatus of the present invention.

SUMMARY OF THE INVENTION

The present invention comprises an apparatus and process for automatically determining the size of small particles by a wet sieving technique. The automated wet sieving apparatus comprises distributing means for supplying wetting liquid onto a sieve, eccentric drive means connected to a distributing means for driving the distributing means, and vacuum and pressure creating means for alternately creating vacuum and then pressure in the liquid collecting vessel to draw undersized particles and wetting liquid through the sieve and then to loosen blinding particles from the sieve. Preferably, the vacuum and pressure creating means, which may be a bellows, is connected to the eccentric drive means which controls both the vacuum and pressure and the application of wetting liquid to the particles on the sieve. A frame for holding at least one sieve is preferably coupled to a vessel by means of a flexible pressure sealing means so that the frame can be tilted as the wetting liquid is distributed on the particles contained on the sieve while vacuum and pressure alternately are being applied to the sieve.

The automated wet sieving process according to the present invention comprises placing particles whose size is to be determined on a sieve, distributing wetting liquid on the sieve to create the suspension of particles in the liquid, and alternately applying vacuum and pressure beneath the sieve to draw undersized particles and liquid through the sieve and to loosen any particles from the sieve which may be blinding the holes of the sieve. Preferably, the wetting liquid is distributed on the sieve in an orbital motion while the sieve is being tilted to impart a swirling action to the suspension of particles and wetting liquid.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is an elevation view, partly in cross section, of an automated wet sieving apparatus according to the present invention.

FIG. 2 is a cross section of a multiple sieve frame structure in accordance with the present invention.

DETAILED DESCRIPTION OF THE PREFERRED EMBODIMENTS

Referring to the drawings in detail, wherein like numerals indicate like elements, there is shown in FIG. 1 an automated wet sieving apparatus in accordance with the present invention designated generally as 10.

Driving means 12, which may be a conventional AC or DC motor is connected through conventional gear means 14 to a drive shaft. The drive shaft may be a one-piece shaft or may consist of upper portion 16 connected to lower portion 20 by coupling 18. Coupling 18 may be flexible. The drive shaft is driven at a preferred speed range of about 30–100 RPM.

Lower portion 20 passes through stationary support 21 and is connected to disk 22 at a portion offset from the center of the disk. Disk 22 is connected by a short connecting shaft 24 to disk 36 at a position offset from the point of connection of drive shaft 20 to disk 22. Member 26, which may be in the shape of a disk, block or rod, moves freely on shaft 24 and thereby functions to impart reciprocal motion to arm 28 which is connected to a vacuum and pressure creating means, such as bellows 30.

Bellows 30 is supported in a stationary position by bracket 32 attached to stationary support 21. When motor 12 is operating, first disk 22 moves in a circular path. Member 26 is pivotally coupled to disk 22 by shaft 24. Arm 28 is connected to shaft 26 in any way that would allow it to reciprocate to the left (as shown in FIG. 1) during one-half of one revolution of the drive shaft. During the other half of the drive shaft revolution, arm 28 will reciprocate to the right. With each movement of arm 28 to the left, air within bellows 30 is forced out, and with every movement of arm 28 to the right, air is drawn into bellows 30. The importance of this will be explained below.

Wetting liquid distributing means 40 is pivotally connected to disk 36 by means of shaft 38 preferably at a position offset from the center of disk 36 and at a position offset from the point of connection of disk 36 to shaft 24. The connection between disk 22 and disk 36 is not pivotable. Wetting liquid is distributed onto the sieve within frame structure 50 from supply container 42 through conduit 44, elbow 41 and nozzle 48. Any suitable valve 46 may control the flow of wetting liquid between supply container 42 and conduit 44.

The wetting liquid must be chosen in such a manner that the liquid will have relatively low surface tension, low viscosity and will be volatile. It should not in any way (physically or chemically) react with the sample of particles whose size are to be determined, and should be a good dispersing agent so that the sample particles do not agglomerate. Obviously, different wetting liquids will be more suitable than others for different types of particles being tested. Conduit 44 should be made of solvent-resistant tubing so as not to be attacked, dissolved, or degraded by the particular wetting liquid being used. All other parts of the apparatus which come in contact with the wetting liquid should be resistant to any deteriorating effects of the wetting liquid.

Nozzle 48 is connected to the outlet of elbow 41 and is disposed within frame 50. Roller 49 is rotatably mounted on nozzle 48 such that nozzle 48 acts as the axle for roller 49. The outer surface of roller 49 bears against the inner wall of frame means 50.

Frame means 50 comprises a sleeve or collar 51 disposed on top of funnel 52. The sleeve and funnel are preferably stainless steel and of conventional construction. Disposed between sleeve 51 and funnel 52 is sieve 53 which rests upon a sealing gasket 55. Sleeve 51 is clamped to funnel 52 by means of any suitable clamp 54. The lower portion of funnel 52 is connected by pressure sealing means 56 to tube 57 which passes through one-hole stopper 62 into the interior of any suitable liquid collecting vessel 64, such as a 1000 ml filter flask. Pressure sealing means 56 may be simply a piece of flexible pressure tight tubing which allows for the tilting of the frame means 50 as indicated at 58 and 60. The tilting of the frame means results from the orbital motion of distributing means 40 as it is driven by the eccentric drive, since the diameter of the orbital path of roller 49 exceeds the inner diameter of sleeve 51.

The interior of bellows 30 communicates with the interior of liquid collecting vessel 64 by means of fluid-tight conduit 66. The extent of the vacuum and pressure alternately transmitted by bellows 30 to vessel 64 is controlled by valves 68 and 70, respectively. The valves are of standard construction and may be either two-way valves or one-way valves. The extent of the vacuum and pressure is also a function of the extent of expansion and contraction of bellows 30, and the speed at which the arm 28 is reciprocated by the driving means.

In FIG. 2, there is shown a conventional multiple sieve frame structure 80 for use with the present invention. Multiple sieve frame means 80 comprises a bottom member 82, which may be a funnel corresponding to funnel 52 in FIG. 1. Funnel 82 has a horizontal, annular flange 84 intergral with its top edge. A gasket 86 is disposed on horizontal flange 84 and supports sieve 88.

The sieves may be any conventional sieves, and are preferably electroformed of pure nickel. The sieves are preferably 3.5 inches in diameter and are strenghened by backing. The highest mesh available should be selected and the sieves preferably should have square holes. In multiple sieve frame means 80, a plurality of sieves are held in vertical alignment arranged from bottom to top in order of increasing hole size.

Disposed on top of sieve 88 is sleeve 90 having lower annular, horizontal flange 92 integral with its lower edge and upper annular, horizontal flange 94 integral with its upper edge. Clamp means 96 of any suitable conventional construction clamps together flange 84 of funnel 82, gasket 86, sieve 88 and flange 92 of sleeve 90 in fluid-tight relationship. In similar fashion, sieve 98 is sealed and clamped between sleeve 90 and sleeve 100, and sieve 102 is clamped between sleeve 100 and sleeve 104.

When multiple sieve frame means 80 is used in place of frame means 50 in the apparatus, the outer surface of roller 49 rolls along the inner wall of sleeve 104 and directs wetting liquid along the edges of sieve 102, or on any other area on the sieve where nozzle 48 is aimed.

The operation of the apparatus will now be described.

A sample of particles whose size is to be determined is placed upon the sieve (or the uppermost sieve if multiple sieve frame means 80 is being used) after the sieves have been calibrated. The wetting liquid flow is then started by opening valve 46 until the desired flow rate is achieved. For a given sieve or series of sieves, sample size and flow rate of the wetting liquid are interrelated. Both the sample size and the rate of flow of the wetting liquid should be chosen so that the analysis will be finished in a few minutes.

Motor 12 is turned on to move distributing means 40 in an orbital path whose diameter is slightly greater than the diameter of the inner wall of sleeve 51. This creates a cyclical tilting motion similar to that achieved by swirling wetting liquid on a sieve by hand. Each revolution of the drive shaft causes the bellows to first create vacuum and then pressure beneath the sieve.

The vacuum draws undersized particles and wetting liquid through the free holes in the sieve resulting in a partial separation. The oversized particles and, in decreasing proportion, some undersized particles, are retained on the sieve and tend to blind the openings, forming a cake. At this point, the normal sieving process may degenerate to filtration. The rotation of the drive shaft proceeds to compress the bellows to build up pressure just high enough to liberate the blinded holes of the sieve, which disperses the cake.

If the apparatus is performing properly, the liquid suspension on the sieve should alternately rise and fall between a minimum of 1 mm and a maximum of 3 mm when the liquid distributing means is being rotated at 30 RPM. By so controlling the height of the liquid suspension, the proper flow of wetting liquid may be adjusted for the most efficient sieving.

An acceptable end point of this exponential type separation is reached when the wetting liquid being drawn through the sieve is clear. This may be detected readily by inspection and indicates that only wetting liquid is being drawn through the sieve. At this point, the flow of the wetting liquid is terminated and the motor is allowed to turn until the wetting liquid is drawn through the sieve. After the motor is turned off, the sieve is removed from the frame. Any particles remaining on the walls of the sleeve are brushed onto the sieve in a draft-free area. The sample and the sieve are allowed to dry, and after cooling, the weight percent of the sample retained on the sieve is calculated.

As indicated above, there is an interrelationship between the hole size of the sieve, the type and weight of sample, the type and flow rate of wetting liquid and the sieving time until an end point is reached. The interrelationship of these sieving parameters may be determined by those of ordinary skill in the art and will be illustrated in more detail with reference to the following general procedures for two types of materials:

PROCEDURE I

The sieving parameters for the particle size analysis of antiperspirant powders are as follows:

| Hole Size μ | Mesh Number (minimum) | Sample Weight g | Freon 113 Wetting Liquid ml | Sieving Time minutes |
|---|---|---|---|---|
| 74 | 200 | 2–15 | 500 | 1 |
| 44 | 246 | 0.3–0.5 | 500 | 3 |
| 15 | 806 | 0.20–0.25 | 700 | 5 |
| 10 | 1016 | 0.10–0.15 | 700 | 7 |
| 5 | 1270 | 0.07–0.10 | 1000 | 10–12 |

For the 5 μ, 10 μ and 15 μ sieves, the sample should be weighed directly on the sieve. For the 44 μ and 74 μ sieves, it is advantageous to weigh by difference. To save time and Freon, tap the assembly holding only the 44 μ and 74 μ sieves a few times before starting the wet sieving. Generally choose a sample weight which will leave a residue of approximately 60–100 mg.

PROCEDURE II

The sieving parameters for the particle size analysis of antacid powders are as follows:

| Hole Size μ | Mesh Number (minimum) | Sample Weight g | Alcohol (SDA-40) Wetting Liquid ml | Sieving Time minutes |
|---|---|---|---|---|
| 74 | 200 | 2.0–2.5 | 750 | 3 |
| 63 | 230 | 0.8–1.0 | 750 | 3 |
| 44 | 246 | 0.5–0.6 | 750 | 5 |
| 30 | 290 | 0.2–0.3 | 1000 | 7 |
| 20 | 390 | 0.15–0.20 | 1000 | 7 |
| 15 | 806 | 0.10–0.15 | 1000 | 10 |
| 10 | 1016 | 0.09–0.10 | 1000 | 15 |
| 5 | 1270 | 0.07–0.10 | 1250 | 25 |

For the 5 μ, 10 μ, 15 μ, 20 μ and 30 μ sieves, the sample should be weighed directly on the sieve. For the 44 μ, 63 μ and 74 μ sieves, it is advantageous to weigh by difference. To save time and alcohol, tap the assembly holding only the 44 μ, 63 μ and 74 μ sieves a few times before starting the wet sieving. Generally, choose a sample weight which will leave a residue of approximately 60–100 mg.

By applying the general techniques of wet sieving and referring to the above general procedures, one skilled in the art could determine readily the sieving parameters required for the most efficient automated wet sieving according to the process and apparatus of the present invention for analyzing the particle size of almost any material. The automated wet sieving apparatus of the present invention is a very precise and accurate instrument for the analysis of particle size. It competes in accuracy and precision with the significantly more expensive Coulter Counter.

The present invention may be embodied in other specific forms without departing from the spirit or essential attributes thereof and, accordingly, reference should be made to the appended claims, rather than to the foregoing specification as indicating the scope of the invention.

We claim:

1. An automated wet sieving apparatus comprising:
   (a) distributing means for supplying wetting liquid to a sieve containing particles to be sieved;
   (b) eccentric drive means connected to said distributing means for driving said distributing means in an orbital path about a vertical axis generally perpendicular to and generally in the center of said sieve; and (c) vacuum and pressure creating means actuated by said eccentric drive means for alternately creating vacuum and pressure below the sieves, to draw undersized particles through the sieve and loosen particles which may blind the sieve openings.

2. An apparatus according to claim 1 further comprising flexible frame means for the holding the sieve so that the sieve may be tilted by the orbital motion of the distributing means about said vertical axis.

3. An apparatus according to claim 2 wherein said distributing means is driven in an orbital path having a diameter greater than the diameter of said frame means to tilt said sieve.

4. An apparatus according to claim 2 wherein said frame means holds a plurality of sieves in vertical alignment, said sieves being arranged from bottom to top in order of increasing hole size.

5. An apparatus according to claim 1 wherein said vacuum and pressure creating means is a bellows.

6. An apparatus according to claim 1 further comprising valve means associated with said vacuum and pressure creating means for varying the extent of vacuum and pressure being created.

7. An automated wet sieving apparatus comprising:

(a) distributing means for supplying wetting liquid to a sieve containing particles to be sieved;

(b) eccentric drive means connected to said distributing means for driving said distributing means in an orbital path about a vertical axis generally perpendicular to and generally in the center of said sieve;

(c) vacuum and pressure creating means for alternately creating vacuum and pressure below the sieve to draw undersized particles through the sieve and loosen particles which may blind the sieve openings; and (d) flexible frame means for holding the sieve so that the sieve may be tilted by the orbital motion of the distributing means;

said distributing means being pivotally mounted on said eccentric drive means, said distributing means having an inlet connected to a source of wetting liquid and an outlet comprising a nozzle disposed within said frame means above the sieve, and a roller rotatably mounted on said distributing means such that the nozzle is the axle for said roller, the outer surface of said roller being disposed within said frame means and against the inner wall of said frame means, said distributing means being driven in said orbital path, said orbital path having a diameter greater than the diameter of the inner wall of said frame means so as to tilt the sieve as said distributing means is driven in said orbital path.

8. An automated wet sieving apparatus comprising:

(a) distributing means for supplying wetting liquid to a sieve containing particles to be sieved;

(b) eccentric drive means connected to said distributing means for driving said distributing means in an orbital path about a vertical axis generally perpendicular to and generally in the center of said sieve; and (c) bellows for alternately creating vacuum and pressure below the sieve to draw undersized particles through the sieve and loosen particles which may blind the sieve openings, one end of said bellows being mounted on a stationary support, the interior of said bellows being in pressure tight connection with the interior of a liquid collecting vessel, the other end of said bellows being connected to said eccentric drive means, whereby one-half of each revolution of said drive means causes the bellows to create vacuum in said vessel and the other half of each revolution of said drive means causes the bellows to create pressure in said vessel.

9. An automated wet sieving apparatus comprising:

(a) distributing means for supplying wetting liquid to a sieve containing particles to be sieved;

(b) eccentric drive means connected to said distributing means for driving said distributing means in an orbital path about a vertical axis generally perpendicular to and generally in the center of said sieve, said eccentric drive means comprising a motor connected to a first disk at a position offset from the center of said first disk, a member connected to said first disk at a position offset from the point of connection of said motor to said first disk, a second disk connected to said member, said distributing means pivotally connected to said second disk;

(c) vacuum and pressure creating means for alternately creating vacuum and pressure below the sieve to draw undersized particles through the sieve and loosen particles which may blind the sieve openings; and (d) actuating means for actuating said vacuum and pressure creating means, said actuating means connecting said member to said vacuum and pressure creating means.

* * * * *